United States Patent [19]

Lawrence

[11] Patent Number: 4,483,465

[45] Date of Patent: Nov. 20, 1984

[54] FLUIDIC SUBSTANCE DISPENSING VALVE

[75] Inventor: David Lawrence, Billerica, Mass.

[73] Assignee: Automation Associates, Inc., Billerica, Mass.

[21] Appl. No.: 290,343

[22] Filed: Aug. 5, 1981

[51] Int. Cl.[3] ..... B67B 7/26; B65D 47/10

[52] U.S. Cl. ..... 222/83.5; 222/502; 222/505; 222/512; 222/513; 222/515; 222/525; 222/529; 251/353; 251/354

[58] Field of Search ..... 222/82–83, 222/83.5, 91, 490, 502, 505, 507–509, 512–515, 517–518, 522, 525, 528–529, 402.21, 402.24; 251/349, 354, 353

[56] References Cited

U.S. PATENT DOCUMENTS

| | | | |
|---|---|---|---|
| 2,665,037 | 1/1954 | Zublin | 222/490 |
| 3,187,918 | 6/1965 | Moore | 222/83 X |
| 3,321,114 | 5/1967 | Croyle | 222/525 X |

FOREIGN PATENT DOCUMENTS

| | | | |
|---|---|---|---|
| 867634 | 4/1971 | Canada | 222/402.24 |
| 1807551 | 5/1970 | Fed. Rep. of Germany | 222/512 |

*Primary Examiner*—Charles A. Marmor
*Attorney, Agent, or Firm*—Jerry Cohen

[57] ABSTRACT

A valve for dispensing fluidic substance including a valve housing (12) defining a general axial flow path through the housing, a diaphragm (22) disposed in the valve housing substantially transverse to the axial flow path and defining first and second compartments (38, 39) therein, the diaphragm having a surface facing away from the flow path which includes an annular rib (32) and further having at least one aperture (34) disposed through the diaphragm in a peripheral arrangement outside of the annular rib for allowing passage of fluidic substance from the first compartment to the second compartment, a tubular seal mounted to the valve housing and having an inner end (46) which opens to face the annular rib of the diaphragm, an outer end (50), an annular lip (60) defining the inner end of the seal, and being annularly pivotable relative to the pivoting break sealing engagement between the diaphragm and the tubular seal so that fluidic substance in the second compartment is permitted access to the bore (44) of the tube, the outer end of the tubular seal having at least one orifice (52) for dispensing fluidic substance therefrom.

27 Claims, 10 Drawing Figures

FLUIDIC SUBSTANCE DISPENSING VALVE

BACKGROUND OF THE INVENTION

This invention relates to a valve for dispensing fluidic substances.

A container holding one of a wide variety of fluidic substances such as, for example, medicinal material, toner for copying machines or liquid chemicals, often requires a stopper or cap which includes a control valve for dispensing the fluidic material when desired. Such valves, as represented by U.S. Pat. No. 4,164,307, typically exhibit a ball or other valve element fittable into a valve seat. When so fitted, the valve is closed and fluidic substance, typically driven by force, such as pressure, created, for example, by squeezing the container or otherwise, or gravity due to inverting the container, is blocked from flowing through the valve. To open the valve the operator exerts inward force on a rod extending from the valve element, thereby unseating the element to permit the fluidic substance to pass through the valve seat. Typically a spring or similar means urges the ball into the seat thus closing the valve when inward pressure on the rod is removed.

Present dispensing valves exhibit several deficiences. For example, improper fit or a loose seal between the ball and seat may result in leaking of the fluidic substance. In cases where the valve is used as a shipping cap secured to a shipped container of fluidic material, rough handling or jostling may lead to accidental opening of the valve and consequent leaking of the fluidic contents. Accidental valve opening is likely because the mass of present valve elements is often relatively large. When the elements are jarred the spring resistance sealing those elements together is overcome and the valve opens. The numerous small distinct parts such as springs, clips and washers used in many present valves add to the difficulty and expense of manufacturing the valves.

It is therefore an object of this invention to provide a valve for dispensing fluidic substances which is resistant to accidental opening and prevents leaking of fluidic substance by providing an improved seal.

It is a further object of this invention to provide an improved dispensing valve having fewer internal parts thereby being simple and inexpensive to construct and reducing valve malfunction.

It is a further object of this invention to provide an improved dispensing valve which dependably closes and opens during repeated use.

It is a further object of this invention to provide an improved dispensing valve which also serves as a cap for a fluidic substance container.

SUMMARY OF THE INVENTION

This invention features a valve for dispensing fluidic substances having a valve housing adapted for connecting with a source of fluidic substance. The valve housing typically has a threaded opening for securing to the threaded spout of a container, the end of a hose, or other source of fluidic substance. A chamber within the housing accommodates incoming fluidic material, which is driven into the housing by gravity, pressure or the like. The chamber further defines a generally axial flow path through the valve housing.

A diaphragm means is disposed in the valve housing chamber substantially transverse to the axial flow path and sealingly engages the chamber wall so as to define first and second compartments therein. The surface of the diaphragm facing away from the flow path forms an annular rib. At least one aperture is disposed through the diaphragm outside of the annular rib for allowing the passage of fluidic substance from the first compartment to the second compartment. Typically a circular arrangement of apertures is provided.

Also mounted in the valve housing is a tubular seal having an inner end which opens to face the annular rib of the diaphragm and an outer end connecting with the region outside the valve housing. The tubular seal comprises a first tube section extending inwardly from the outer end, a second tube section interconnected to the first section and including at least one lobe protruding from the inside wall thereof and an annular lip interconnected with the second tube section and defining the inner end of the tubular seal. The tubular seal further includes pivot means for enabling the second tube section and annular lip to annularly pivot relative to the first tube section and resilient means urging the tube sections axially outward so that the annular lip sealingly engages the annular rib of the diaphragm.

The tube sections are movable axially inward; the lip and second tube section annularly pivot to enable the lobes to engage the annular diaphragm rib thereby breaking sealing engagement between the diaphragm and the tubular seal so that fluidic substance in the second compartment of the valve housing chamber is permitted access to the inside of the tube sections.

The outer end of the tubular seal includes at least one orifice for dispensing fluidic substance from inside the tubular seal.

In addition to dispensing applications the valve of this invention may be used as a shipping or storing cap for containers of fluidic material.

In a preferred embodiment the tubular seal comprises an integral member composed of a resilient material, such as plastic, which is flexible enough to permit the aforementioned annular pivoting but is sufficiently rigid for allowing the tube to be urged inwardly without randomly buckling along its length. The resilient material is shaped, such as by molding, so that the first tube section is urged outwardly and thus returns to an outward condition, sealing the valve closed, when inward pressure on the tubular seal is released.

The diaphragm is typically composed of a resilient material, similar to that of the tubular seal, which resiliently urges the annular rib into sealing engagement with the annular lip of the tubular seal and flexes or deforms in response to the inward force of the tubular seal bearing on the annular rib. When inward pressure on the tubular seal is halted the diaphragm springs back to regain its original, closed condition shape.

Typically, the diaphragm and tubular seal are shaped to have relatively high spring constants urging them into sealing engagement. Further, both elements have relatively small masses. Accordingly the valve resists any tendency to open accidentally when jarred or jostled, such as during shipping.

It is preferred that the lobes be integral protrusions or bumps on the inside wall of the second tube sections. However, such lobes may be distinct from the inside wall and fixed thereto adhesively or otherwise.

Preferably the annular lip extends in a generally radial manner to sealingly engage the inside wall of the second chamber compartment. In this manner the diaphragm and tubular seal define an annular enclosure in the second compartment for accommodating fluidic substance received from the first chamber compartment through the apertures of the diaphragm.

The outer end of the tubular seal, through which the fluidic substance is dispensible, may extend outside of the valve housing or may conversely be recessed in the housing. A recessed tube is protected during periods of nonuse, such as during shipping, without the need for a protective cap. Such a cap may be used; however, in embodiments exhibiting either an external or recessed tube and is mountable to the valve housing threadingly, by snap fit, or in any acceptable manner.

The valve housing may include supports, of various geometries, which bear against the annular lip of the tubular seal to resist outward motion or distortion of the lip. Typically the valve housing is contoured to provide such supports. This feature is particularly desirable where fluidic substance enters the valve under high pressure. The supports resist the tendency of the tubular seal to "blow out" under such pressure.

In certain embodiments the opening of a container or other source of fluidic substance may be covered by a pierceable membrane. In such instances the diaphragm may include penetrating means such as a pointed member interconnected to the surface of the diaphragm opposite the annular rib for penetrating the membrane when the tubular seal is pressed inwardly and the diaphragm is consequently flexed.

Other objects, features and advantages of the invention will become apparent from the following detailed description of preferred embodiments with reference therein to the accompanying drawing in which:

DETAILED DESCRIPTION OF PREFERRED EMBODIMENTS

Figure 1:
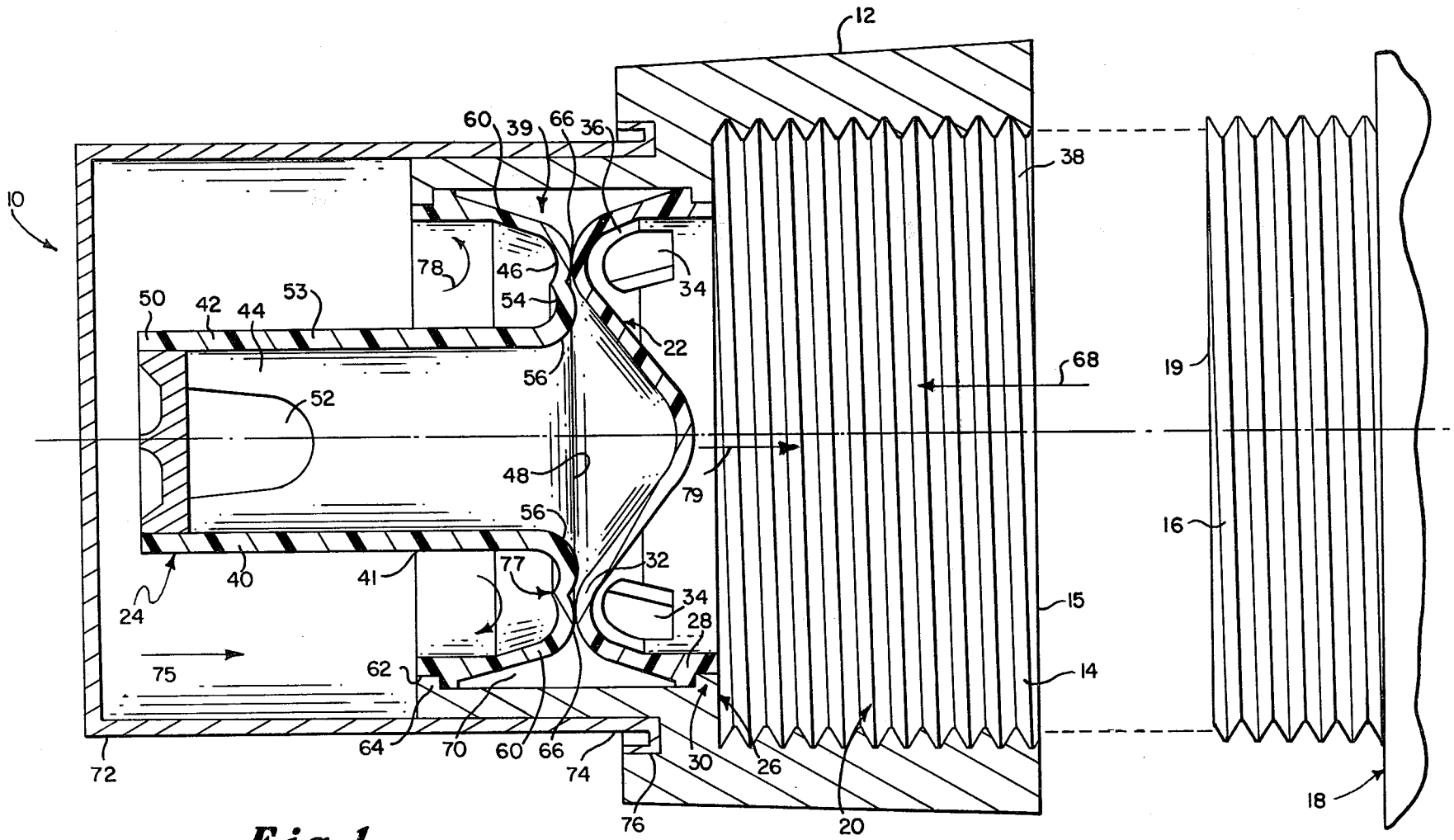
FIG. 1 is a cross-sectional view of the dispensing valve of this invention in the closed condition and a container to which the valve is attached.

There is shown in FIG. 1 dispensing valve 10 of a preferred embodiment of the present invention in a closed condition. A valve housing 12 is threaded at 14 so that opening 15 may securely receive threaded spout 16 of container 18 and connect with container 18 through opening 19 thereof.

Housing 12 includes a chamber 20. Mounted therein are a diaphragm 22 and a tubular seal 24. Diaphragm 22 sealingly engages the inside wall 26 of housing 12; stepped portion 28 of diaphragm 22 fits into stepped portion 30 of wall 26. Diaphragm 22 forms an annular rib 32 facing away from opening 15. A peripheral array of apertures 34 arranged in a circular configuration are disposed through rim 36 of diaphragm 22. Diaphragm 22 divides chamber 20 into two compartments 38, 39.

Tubular seal 24, includes an elongated tube 40 which extends through an opening 41 in housing 12 and has a tube wall 42 and bore 44. Inner end 46 is open at 48. Outer end 50 includes at least one orifice 52 and may include similar unpictured orifices arranged peripherally about outer end 50. First tube section 53 extends from end 50 and is integral with second tube section 54. Section 54 includes lobes 56 integrally protruding from the inside of wall 42.

An annular lip 60 is integrally interconnected to second section 54 and extends generally radially outward to sealingly engage wall 26 in second compartment 39; stepped portion 62 of lip 60 fits notched portion 64 of wall 26. Further, lip 60 sealingly engages annular rib 32 forming an annular seal along 66.

Fluidic substance enters housing 12 in the direction of arrow 68. The force driving the fluidic material may include gravity, due to inverting container 18, pressure such as from squeezing container 18, or other suitable driving means. Apertures 34 permit passage of fluidic substance from compartment 38 to an annular enclosure 70 contained within second compartment 39 and bounded by wall 26, lip 60, rib 32 and seal 66. Seal 66 prohibits fluidic material in enclosure 70 from passing through opening 48 and into bore 44 of tube 40.

A cap 72 is shown secured to housing 12. Cap 72 is attached such as by snap or friction insertion of cap lip 74 into a slot 76 in housing 12. Cap 72 may be alternatively mounted to housing 12 threadingly or otherwise.

Tube wall 42 ls composed of a resilient material such as plastic or the like. Tubular seal 24 is annularly pivotable generally along the curved area 77 which includes both tube wall 42 and lip 60. Diaphragm 22 is composed of a similar resilient material.

Figure 2:
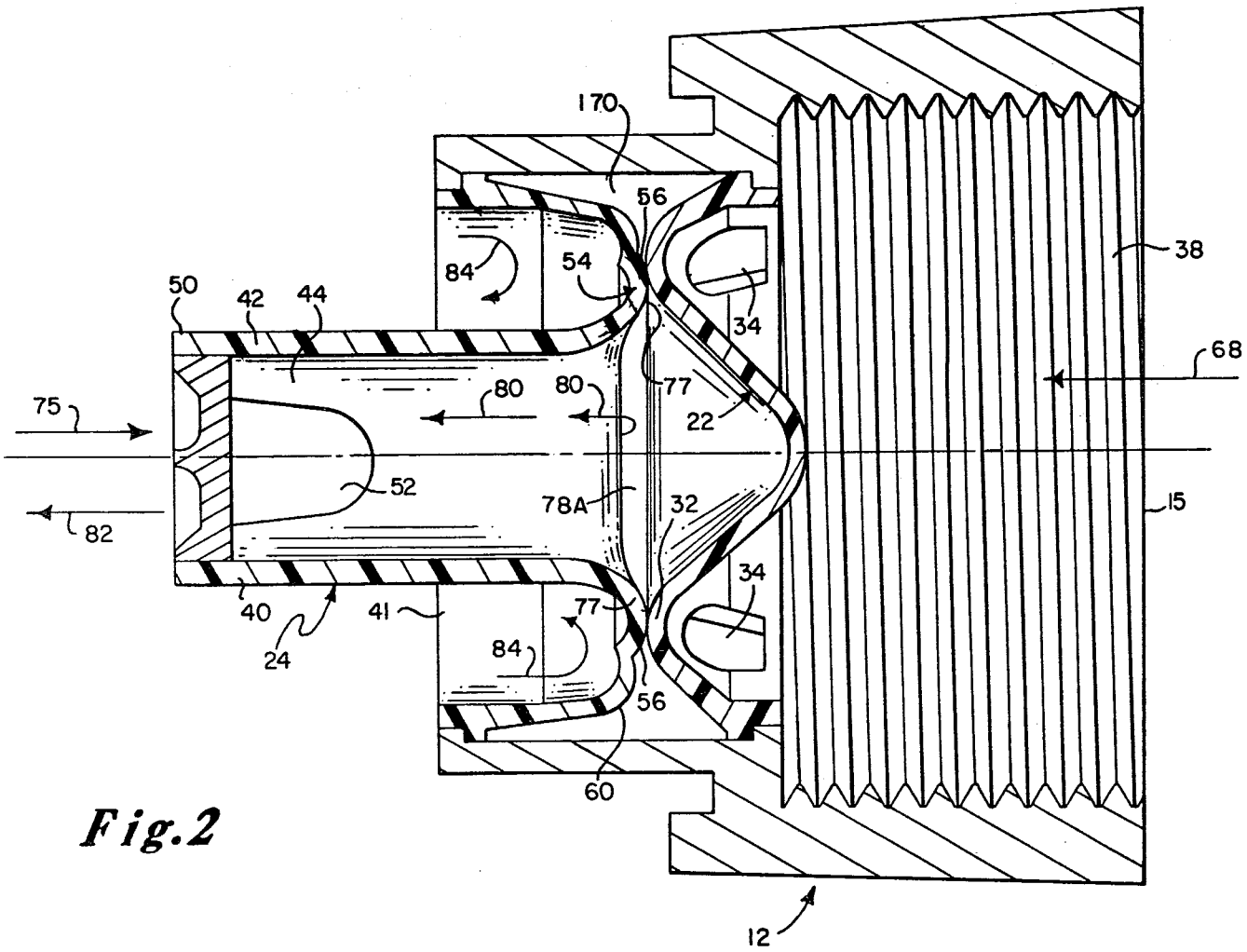
FIG. 2 is a view similar to that of FIG. 1 showing the dispensing valve in an open condition.

To open the valve, cap 72 is removed and outer end 50 of tubular seal 24 is pressed inwardly in the direction of arrow 75. Lip 60 and second tube section 54 are caused to pivot in the direction of arrow 78. Diaphragm 22 flexes or deforms slightly in the direction of arrow 79. These movements enable lobes 56 to be carried into essentially point contact engagement with rib 32, FIG. 2 at 77. An opening 78A (FIG. 2) is therefore created through which fluidic material in enclosure 70 is forced either by gravity or pressure from container 18. The fluidic substance travels down tube bore 44 in the direction of arrows 80 and exits through orifices 52.

To close the valve inward pressure 75 is removed. The material resilience (plastic memory) of diaphragm 22 and seal 24 urges tube 40 outward in the direction of arrow 82. Second tube section 54 and lip 60 pivot in the direction of arrows 84 and lip 60 is once again brought into sealing engagement with rib 32, as in FIG. 1.

The spring constants of the resilient forces urging diaphragm 22 and seal 24 into sealing engagement are sufficiently large in relation to the mass of these elements to resist unintended separation of the lip 60 and rib 32 (opening of the valve) and consequent leaking of the fluidic substance. This is particularly important when valve 10 is utilized as a shipping cap for container 18 and at other times when the valve is subjected to severe jostling which would tend to accidentally separate lip 60 and rib 32.

Figure 6:
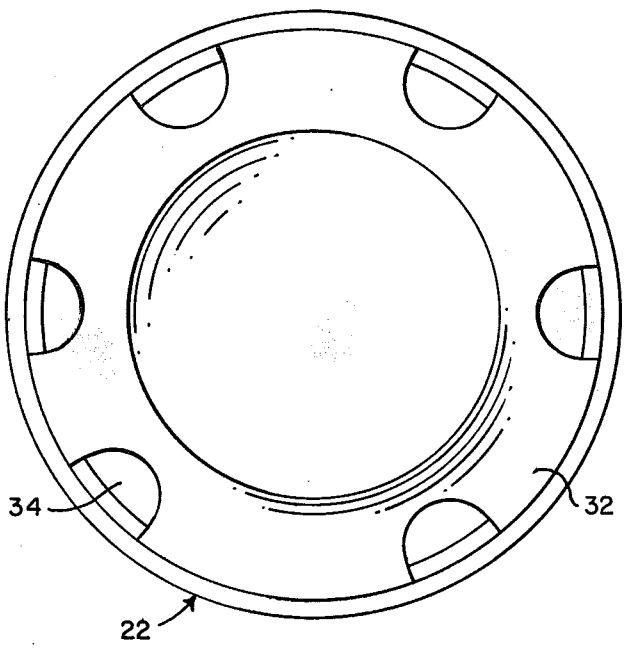
FIG. 6 is an end view of the diaphragm taken from the left side of FIG. 3.
Figure 4:
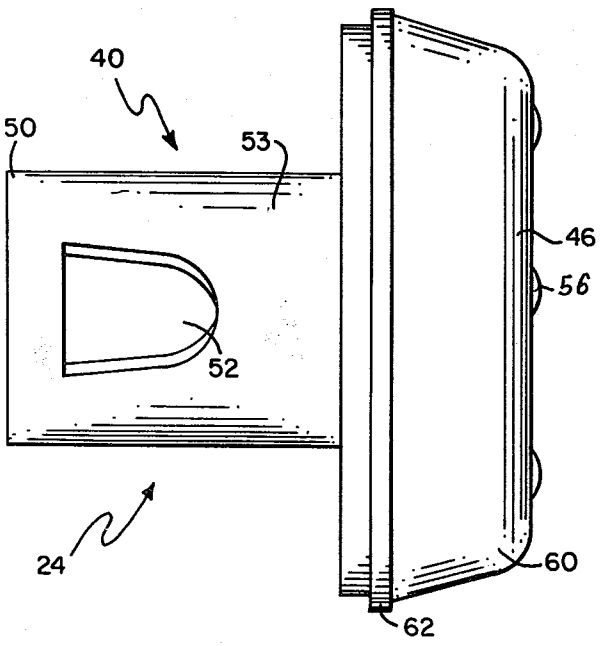
FIG. 4 is a plan view of the tubular seal.
Figure 3:
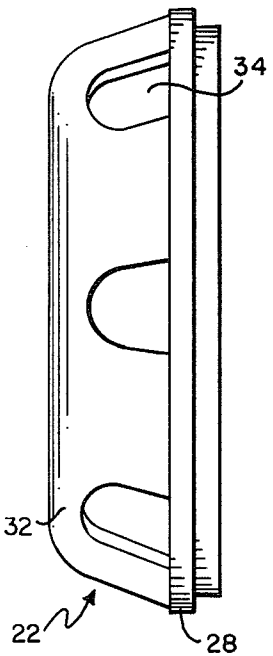
FIG. 3 is a plan view of the diaphragm.
Figure 5:
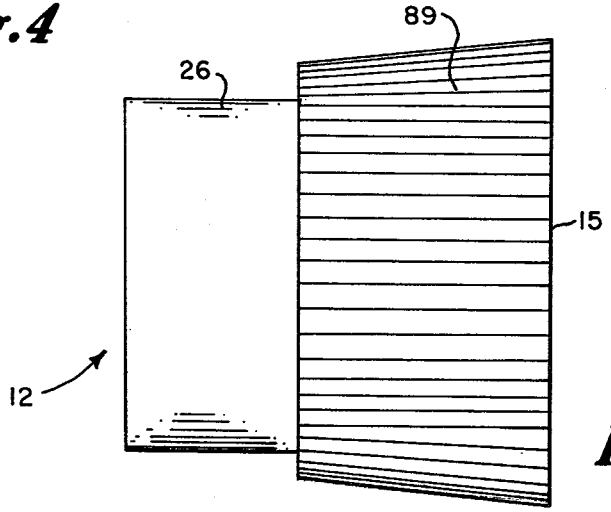
FIG. 5 is a plan view of the valve housing.

FIGS. 3–5 provide plan views of diaphragm 22, tubular seal 24 and housing 12. FIG. 6 illustrates an end view of diaphragm 22 showing clearly the circular configuration of apertures 34. FIG. 5 discloses a valve housing 12 having an axially notched surface 89 which provides frictional contact so that housing 12 may be threadably secured to a threaded container spout, as in FIG. 1.

Figure 7:
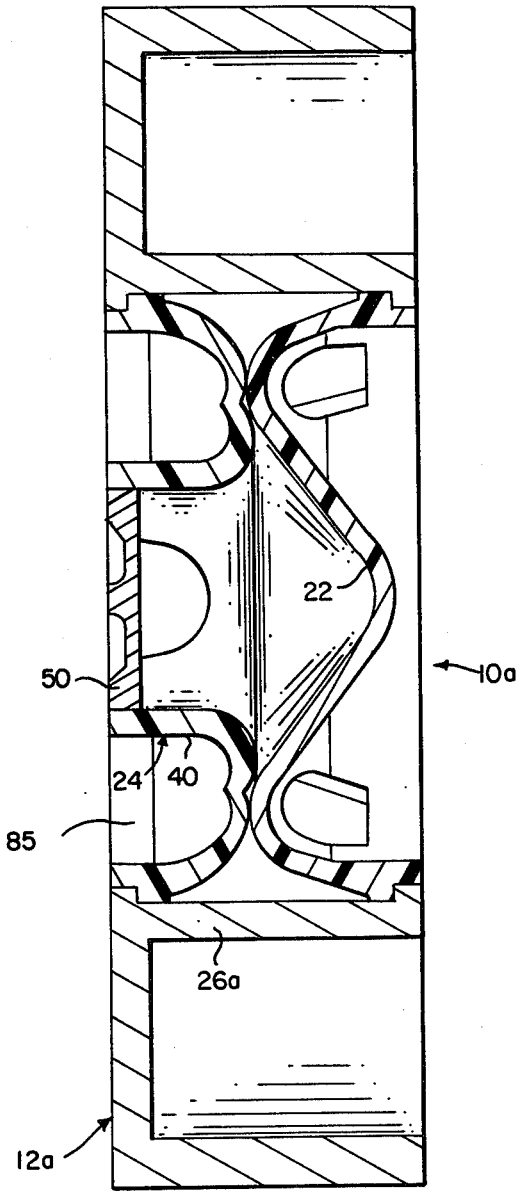
FIG. 7 is a cross-sectional view of an embodiment of the valve of this invention wherein the tubular seal is fully recessed within the valve housing.

Cap 72, described with FIG. 1, protects outer end 50 of tubular seal 24 and prevents unintended opening of the valve such as during shipping. Alternatively, as shown in FIG. 7, tubular seal 24 be recessed within valve housing 12*a* thereby performing a protective function identical to that of cap 72. Housing hole 85 is sufficiently wider than tube 40 to provide access to the outer end 50 of tube 40. Valve 10*a* of FIG. 7, and its individual parts are otherwise constructed and operated identically to valve 10 of FIGS. 1–6.

Figure 8:
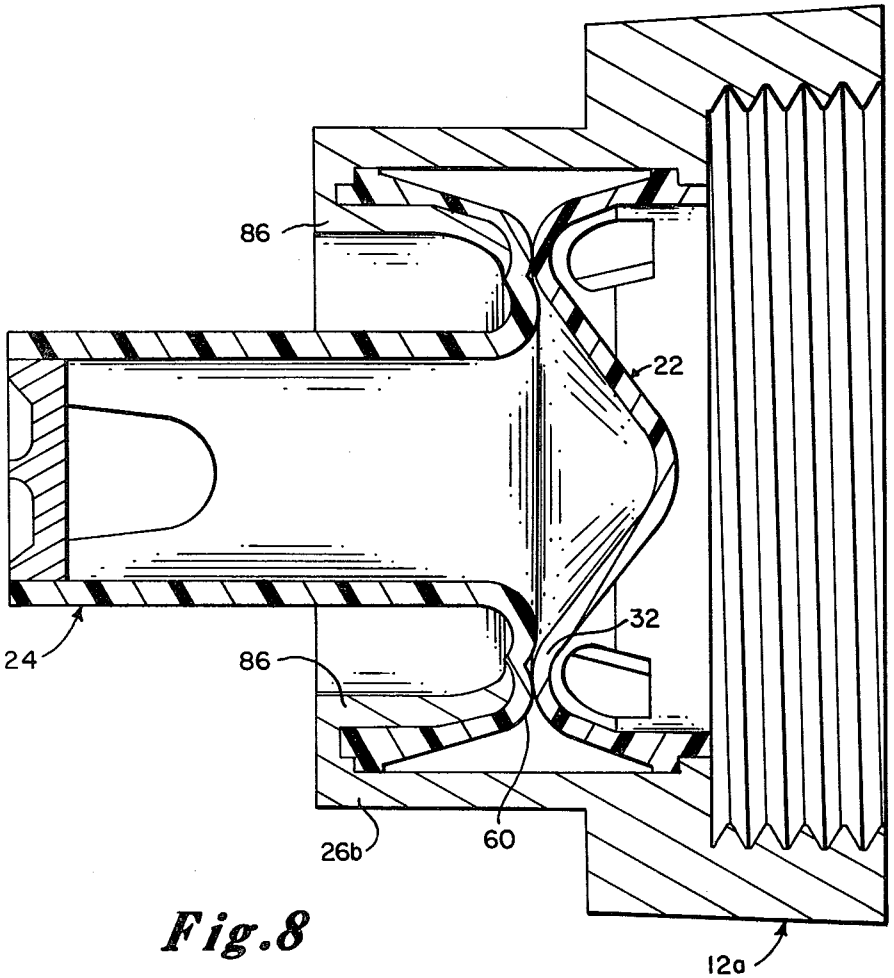
FIG. 8 is a cross-sectional view of an embodiment of the valve of this invention which includes valve housing supports for high pressure applications.

When fluidic material is dispensed under high pressure stress on annular lip 60 may cause the lip to distort. If the pressure is great enough, the entire tubular seal may blow out. In both cases valve malfunction results. This problem may be remedied by contouring the wall 26*b* of housing 12*b*, as in FIG. 8, to form a support 86. Support 86 blocks any distortion of or movement by lip 60 thereby preventing high pressure blow out and valve malfunction.

Figure 9:
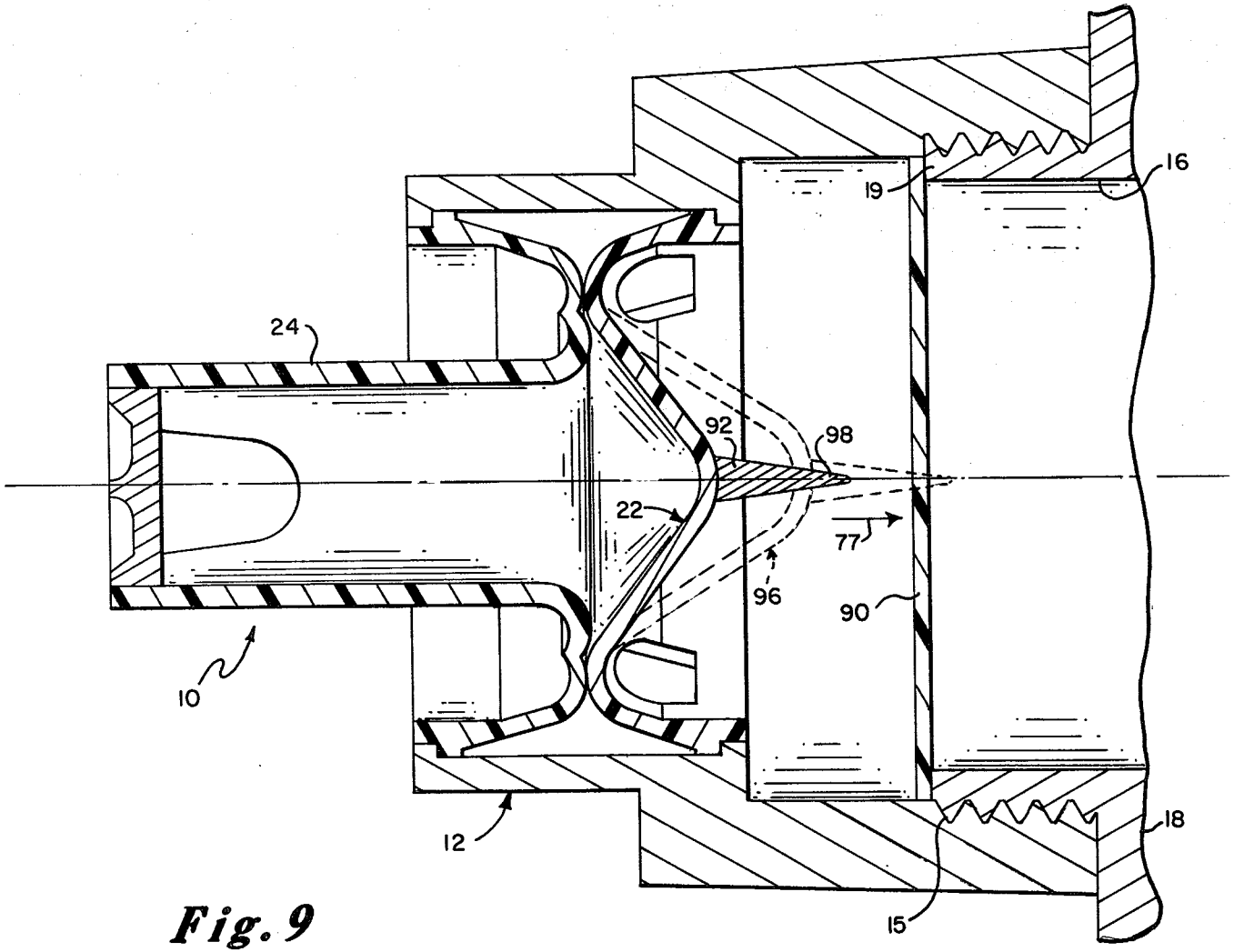
FIG. 9 is a cross-sectional view of an embodiment of the valve of this invention having a penetration member for piercing a membrane covering the opening of a fluidic substance container.

In certain embodiments of this invention, as in FIG. 9, a container 18 using valve 10 may have a thin membrane 90 of foil or other penetrable material covering the opening 19. A penetrating member 92 is interconnected, typically integrally, to a diaphragm 22 so that when diaphragm 22 flexes upon inward movement in the direction of arrow 77 of tubular seal 24 member 92 likewise moves inwardly to position 96 where pointed end 98 pierces membrane 90.

Figure 10:
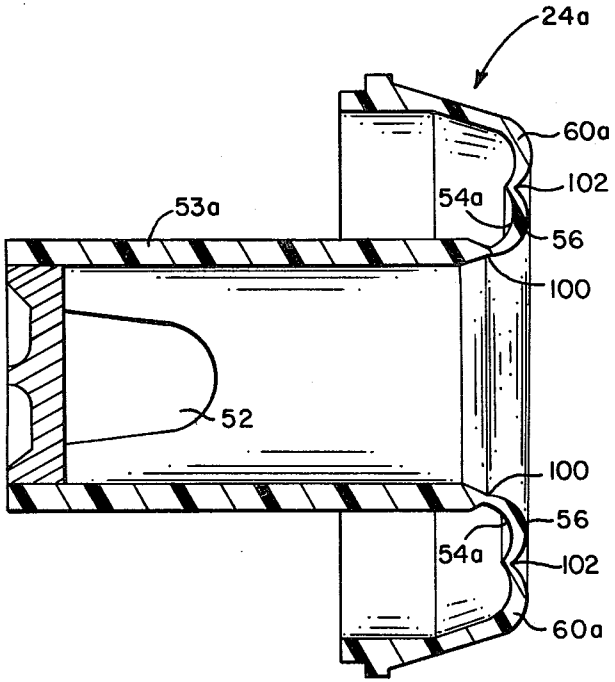
FIG. 10 is a cross-sectional view of an alternative tubular seal wherein the first and second tube sections and the annular lip are pivotably interconnected at narrow points.

As stated during the description of FIG. 1, tube wall 42 of tubular seal 24 typically pivots about a generally curved area 77. Alternatively, as shown in FIG. 10, the tubular seal 24*a* may be pivotal only about a point 100 between first tube section 53*a* and second tube section 54*a* and possibly about a point 102 between section 54*a* and lip 60*a*. Points 100 and 102 are typically thin resilient points in tube wall 42. In such embodiments the remaining portions of tube sections 53*a* and 54*a* and lip 60*a* are rigid and nonpivotable.

The materials of construction of the above-described embodiments are not critical. A variety of plastic behavior materials, including polymers, elastomeric and thermoplastic materials or metals or combinations thereof in mixture or laminate form can be employed. High density polyethylene is preferred for rigid portions of the above-described structure and low density polyethylene (or 50—50, weight basis, blends thereof with ethylene vinyl acetate). Construction processes for parts thereof may comprise (preferably) injection molding or vacuum or thermo-forming or other known methods.

The above-described embodiments are particularly useful in connection with low viscosity liquids, e.g., toner in copy machines. But it may be used for highly viscous fluidic materials, such as shampoos (per se or with modifications to reduce viscosity due to enhanced control through the present invention allowing such reduction).

The above embodiments may be employed in valved caps for bottles (or made integral with plastic bottle) and in other fluidic substance control devices.

It is evident that those skilled in the art, once given the benefit of the foregoing disclosure, may now make numerous other uses and modifications of, and departures from, the specific embodiments described herein without departing from the inventive concepts. Consequently, the invention is to be construed as embracing each and every novel feature and novel combination of features present in, or possessed by, the apparatus and techniques herein disclosed and limited solely by the spirit and scope of the appended claims.

What is claimed is:

1. A valve for dispensing fluidic substance comprising means defining a valve housing adapted for connecting with a source of fluidic substance and including a chamber for accommodating incoming fluidic substance driven by gravity, pressure or the like, and defining a general axial flow path thereof through said housing, diaphragm means disposed in said valve housing chamber substantially transverse to said axial flow path and sealingly engaging the wall of said chamber so as to define first and second compartments therein, said diaphragm means having a surface facing away from said flow path which includes an annular rib and further having at least one aperture disposed through said diaphragm means in a peripheral arrangement outside of said annular rib for allowing passage of fluidic substance from the first compartment to the second compartment, a tubular seal mounted to said valve housing and having an inner end which opens to face the annular rib of said diaphragm means and an outer end, said seal comprising a first tube section extending inwardly from said outer end, a second tube section interconnected to the first section and including at least one lobe protruding from the inside wall thereof, and an annular lip interconnected to the second tube section and defining the inner end of said tubular seal, said tubular seal further including pivot means for enabling the second tube section and annular lip to annularly pivot relative to the first tube section and resilient means urging said tube axially outward so that said annular lip sealingly engages said annular rib of said diaphragm means, said tube being movable axially inward against said resilient means, said lip and second tube section annularly pivoting to enable the lobes of said second section to engage said annular rib thereby breaking sealing engagement between said diaphragm means and said tubular seal so that fluidic substance in said second compartment is permitted access to the bore of said tube, the outer end of said tubular seal having at least one orifice for dispensing fluidic substance therefrom.

2. The valve of claim 1 wherein the annular lip of said tubular seal extends to sealingly engage the wall of the second compartment of said valve housing chamber.

3. The valve of claim 1 wherein said first and second tube sections and said annular lip comprise one integral member.

4. The valve of claim 1 wherein said resilient means are integral with said tubular seal.

5. The valve of claim 1 wherein said diaphragm means includes resilient means urging said annular rib into sealing engagement with the annular lip of said tubular seal and allowing said diaphragm means to flex in response to said inward movement of said tube.

6. The valve of claim 1 wherein said pivot means are integral with said tubular seal.

7. The valve of claim 1 wherein said first tube section is pivotably interconnected to said second tube section.

8. The valve of claim 1 wherein said annular lip is pivotably interconnected to said second tube section.

9. The valve of claim 1 wherein said pivot means are integral with said first tube section.

10. The valve of claim 1 wherein said pivot means are integral with said second tube section.

11. The valve of claim 1 wherein said pivot means are integral with said annular lip.

12. The valve of claim 5 wherein said diaphragm means resilient means are integral to said diaphragm means.

13. The valve of claim 1 wherein each lobe is integral with said second tube section.

14. The valve of claim 1 wherein the outer end of said tubular seal is located outside of said valve housing.

15. The valve of claim 1 wherein the outer end of said tubular seal is recessed within said valve housing.

16. The valve of claim 1 further including a cap mountable to said valve housing for covering the outer end of said tube.

17. The valve of claim 1 further including support means for resisting outward movement by a distortion of the annular lip of said tubular seal.

18. The valve of claim 5 further including for applications in which a membrane is interposed between said source of fluidic substance and said valve housing penetrating means interconnected to the surface of said diaphragm means opposite said annular rib for penetrating said membrane upon inward movement of said tubular seal.

19. A valve for dispensing fluidic substance comprising:

means defining a valve housing adapted for connecting with a source of fluidic substance and including a chamber for accommodating incoming fluidic substance driven by gravity, pressure or the like and defining a general axial flow path thereof through said housing, diaphragm means disposed in said valve housing chamber substantially transverse to said axial flow path and sealingly engaging the wall of said chamber so as to define first and second compartments therein, said diaphragm means having a surface facing away from said flow path which includes an annular rib and further having at least one aperture disposed through said diaphragm means in a peripheral arrangement outside of said annular rib for allowing passage of fluidic substance from the first compartment to the second compartment, a tubular seal mounted to said valve housing having an inner end which opens to face the annular rib of said diaphragm means and an outer end, said tubular seal comprising an integral tube having at least one lobe protruding from the inside wall of said tube and integral thereto, adjacent proximate the inner end of said tube, and an annular lip integrally interconnected to said tube, defining the inner end thereof and extending substantially radially outward to sealingly engage the wall of the second compartment of said valve housing chamber, said tubular seal further including pivot means integral thereto for enabling said tube to annularly pivot about the inner end thereof, said diaphragm means including resilient means integral thereto and said tubular seal including resilient means integral thereto for urging said tube axially outward so that the annular lip of said tubular seal sealingly engages the annular rib of said diaphragm means, said tubular seal thereby defining with said diaphragm means an annular enclosure in the second compartment of said valve housing chamber for accommodating fluidic substance received from the first compartment thereof through the apertures of said diaphragm means, said tube being movable axially inward against said tubular seal resilient means, said diaphragm means flexing against the urging of said diaphragm resilient means and said tube annularly pivoting to enable said lobes to engage said annular rib thereby breaking sealing engagement between said diaphragm means and said tubular seal so that fluidic substance in said annular enclosure of said second compartment is permitted access to the bore of said tube, the outer end of said tubular seal having at least one orifice for dispensing fluidic substance therefrom.

20. The valve of claim 19 wherein said tube is pivotably interconnected with said annular lip.

21. The valve of claim 19 wherein said pivot means are integral with said tube.

22. The valve of claim 19 wherein said pivot means are integral with said annular lip.

23. The valve of claim 19 wherein the outer end of said tube is located outside of said valve housing.

24. The valve of claim 19 wherein the outer end of said tube is recessed within said valve housing.

25. The valve of claim 19 further including a cap mountable to said valve housing for covering the outer end of said tube.

26. The valve of claim 19 further including support means for resisting outward movement by or distortion of the annular lip of said tubular seal.

27. The valve of claim 19 further including, for applications in which a membrane is interposed between said source of fluidic substance and said valve housing, penetrating means interconnected to the surface of said diaphragm means opposite said annular rib for penetrating said membrane upon inward movement of said tubular seal.

* * * * *